US005467905A

United States Patent [19]

Cortese

[11] Patent Number: 5,467,905

[45] Date of Patent: Nov. 21, 1995

[54] REMOVAL DEVICE FOR MACHINES FOR CHECKING, DRYING AND PRESSING SOCKS

[76] Inventor: Carmelo A. Cortese, Via Porrettana 134/4, 40037 Sasso Marconi, Italy

[21] Appl. No.: 323,551

[22] Filed: Oct. 17, 1994

[30] Foreign Application Priority Data

Oct. 22, 1993 [IT] Italy ..... B093A0423

[51] Int. Cl.[6] ..... A47G 25/90

[52] U.S. Cl. ..... 223/112; 223/111; 112/470.15

[58] Field of Search ..... 223/112, 111, 223/120, 60, 75, 76, 77; 112/121.5

[56] References Cited

U.S. PATENT DOCUMENTS

| | | | |
|---|---|---|---|
| 3,319,851 | 5/1967 | Horberg, Jr. | 223/112 |
| 4,515,299 | 5/1985 | Sewell et al. | 223/112 |
| 4,611,733 | 9/1986 | Nishikawa | 223/111 |
| 4,881,477 | 11/1989 | Gazzarini | 223/112 |

*Primary Examiner*—C. D. Crowder

*Assistant Examiner*—Bibhu Mohanty

*Attorney, Agent, or Firm*—Guido Modiano; Albert Josif

[57] ABSTRACT

The sock removal device is associated with machines for checking, drying and pressing men's socks, of the type which includes a carousel on the peripheral region whereof multiple shaped elements are distributed, for fitting respective socks. The carousel is movable stepwise at appropriate processing stations. The device includes, at a station for removing the socks from the corresponding shaped elements, a lifting tooth that is suitable to enter a longitudinal slot of the shaped elements so as to act on the top of the sock. Arms for gripping the top of the shaped elements and for lifting the end of the sock are suitable to cooperate with the lifting tooth, and have at least two oscillating arm pairs that have a corresponding pad and can be actuated so as to mutually open and close on supporting elements which are meant for alternating vertical sliding. Two rollers are located above the gripping arms, and a removal belt winds around them; an abutment roller is suitable to cooperate with one of the rollers and is supported at the end of an oscillating arm. A tube for delivering a flow of compressed air which lies above the region where the abutment roller acts is suitable to direct the sock onto the removal belt.

8 Claims, 3 Drawing Sheets

REMOVAL DEVICE FOR MACHINES FOR CHECKING, DRYING AND PRESSING SOCKS

BACKGROUND OF THE INVENTION

The present invention relates to a removal device for machines for checking, drying and pressing socks, particularly men's socks.

It is known that socks are subjected to appropriate heat treatments during production. Appropriate infrared-ray devices, for example, are used particularly to perform drying and pressing.

Machines for drying and pressing men's socks are currently known which comprise a carousel having appropriate shaped elements on which said socks are fitted and stretched. The socks inserted on the shaped elements are carried by the carousel inside a drying chamber, for example of the infrared-ray type, and then removed to be sent to additional packaging steps.

Said shaped elements are generally constituted by a template having the same profile as the socks; said template is formed for example by a metal plate or by an appropriately curved tubular element. The sock is fitted manually on the template by the assigned personnel, who stretch the sock uniformly and also check for the presence of any defects.

The sock is instead removed from the shaped element automatically, in an appropriately provided station located downstream of the drying chamber. This removal is rather difficult and requires a certain effort on the sock. It is in fact necessary to pass beyond the discontinuity constituted by the folded portion of the shaped element that corresponds to the foot and heel of the sock.

Furthermore, the sock is generally removed along a direction that is oblique with respect to the longitudinal axis of said sock and in practice coincides with the inclination of the foot. This can easily cause defects along the body of the sock.

SUMMARY OF THE INVENTION

A principal aim of the present invention is to solve the previously described problem by providing a device that allows to easily remove socks in machines for checking, drying and pressing said socks so as to avoid damaging them.

Another aim of the present invention is to provide a removal device which is simple in concept, safely reliable in operation, and versatile in use.

According to the invention, there is provided a removal device for machines for checking, drying and pressing men's socks, of the type which comprises a carousel on the peripheral region whereof multiple shaped elements are distributed, in which respective socks are meant to be fitted on the shaped elements, and in which the carousel is suitable to be moved stepwise at appropriate processing stations. The device is characterized in that it comprises, at a station for removing the socks from the corresponding shaped elements: a lifting tooth suitable to enter a longitudinal slot of the shaped elements so as to act on the top of the sock and actuatable by actuation elements which act along an axis that lies horizontally and radially with respect to the carousel. The actuation elements are slideably supported along a post that is rigidly coupled to a fixed frame of the machine and parallel to the shaped elements. Means for gripping the top of the shaped elements and for lifting the end of the sock are provided, which have at least two arms that can oscillate on a horizontal plane, which have a corresponding pad, and which can be actuated so as to mutually open and close on supporting means which are meant for alternating vertical sliding. The device furthermore includes: two rollers around which a removal belt winds; a conterrotating abutment roller supported at the end of an oscillating arm adapted to cooperate with one of the rollers during removal; and a tube for delivering a flow of compressed air which lies above the region where the abutment roller acts and is suitable to direct the sock onto the removal belt.

BRIEF DESCRIPTION OF THE DRAWINGS

The details of the invention will become apparent from the following detailed description of a preferred embodiment thereof and, illustrated only by way of non-limitative example in the accompanying drawings, wherein.

DESCRIPTION OF THE PREFERRED EMBODIMENTS

Figure 1:
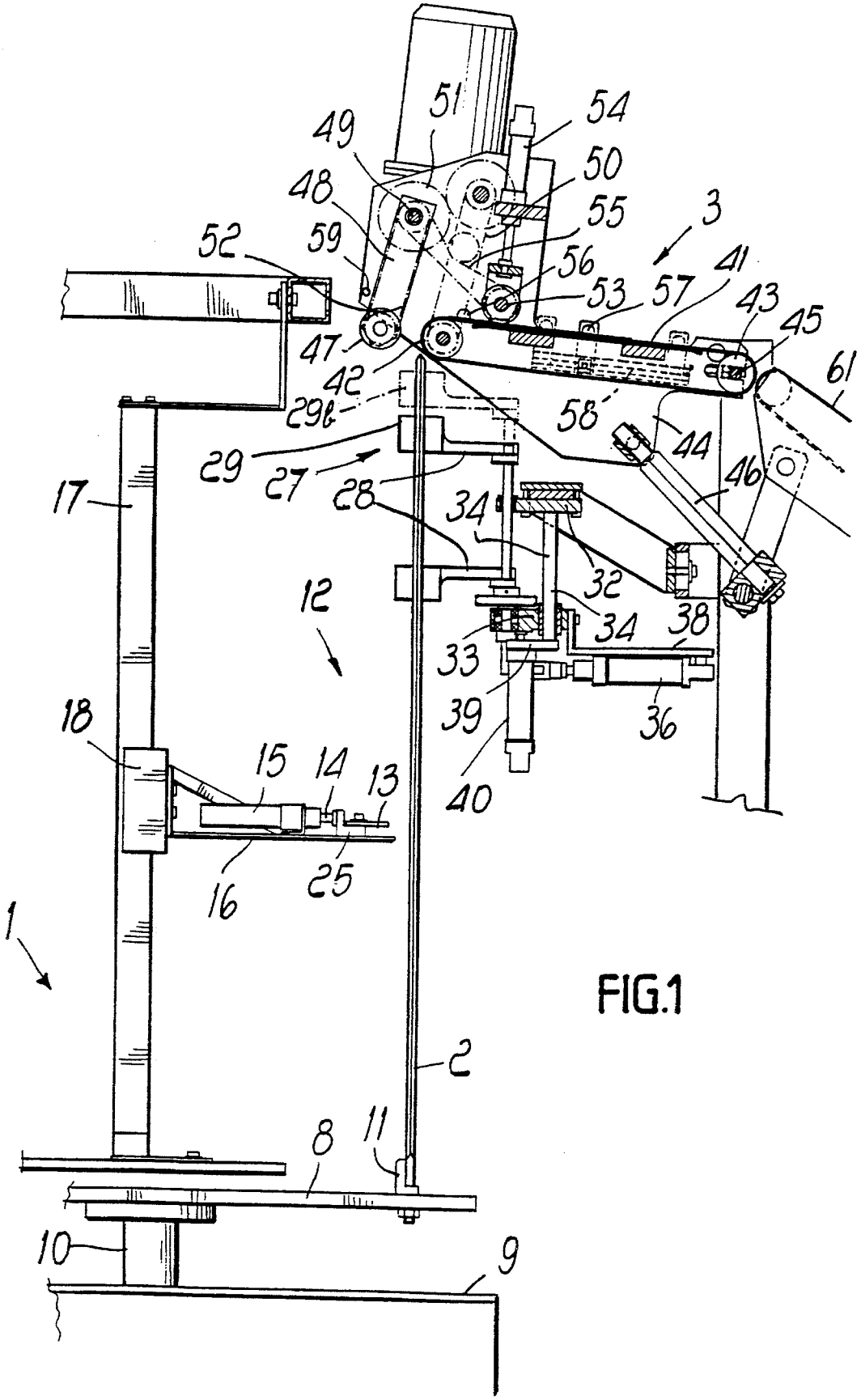
FIG. 1 is a sectional side view, taken along a vertical plane, of the sock removal device according to the invention.

With particular reference to the above figures, the reference numeral 1 generally designates a carousel on which multiple shaped elements 2 are peripherally distributed; respective socks are meant to be fitted over said shaped elements, which have the form of the socks. The carousel 1 can be actuated stepwise in a conventional manner at appropriate processing stations, where the socks are checked, dried, and removed from the shaped elements 2 to send them to a suitable output unit 3.

Figure 5:
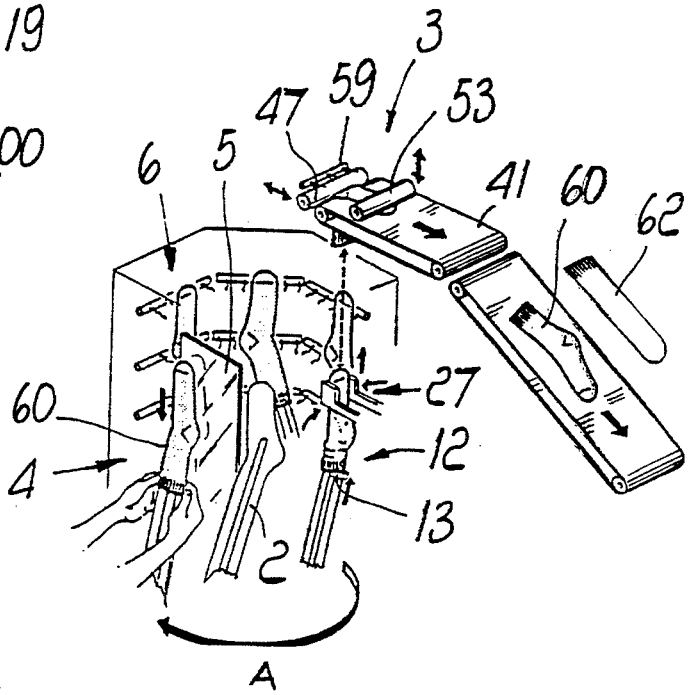
FIG. 5 is a schematic perspective view of the operating steps of the machine according to the invention.

In particular, the socks are checked at a station 4 for fitting said socks over the shapes 2, with the aid of a mirror 5, whereas drying is performed inside a medium-wavelength infrared-ray chamber 6 located downstream of the fitting station 4 along the direction A of the rotation of the carousel 1 (see FIG. 5).

The shaped elements 2 are essentially constituted by a flat template comprising an elongated, practically straight lower portion 2*a* and an upper portion 2*b* that is shaped like the profile of the foot. The shaped elements 2 are affected by a longitudinal slot 7 that runs along the elongated portion 2*a* and ends at the heel of the shaped portion 2*b*.

The carousel 1 has a platform 8 that is rotatable about a vertical axis above a base frame 9; the platform 8 is keyed to the output shaft 10 of a drive unit, not shown, which rotates the platform stepwise. The platform 8 peripherally supports multiple coupling elements 11 for corresponding shaped elements 2.

Figure 4:
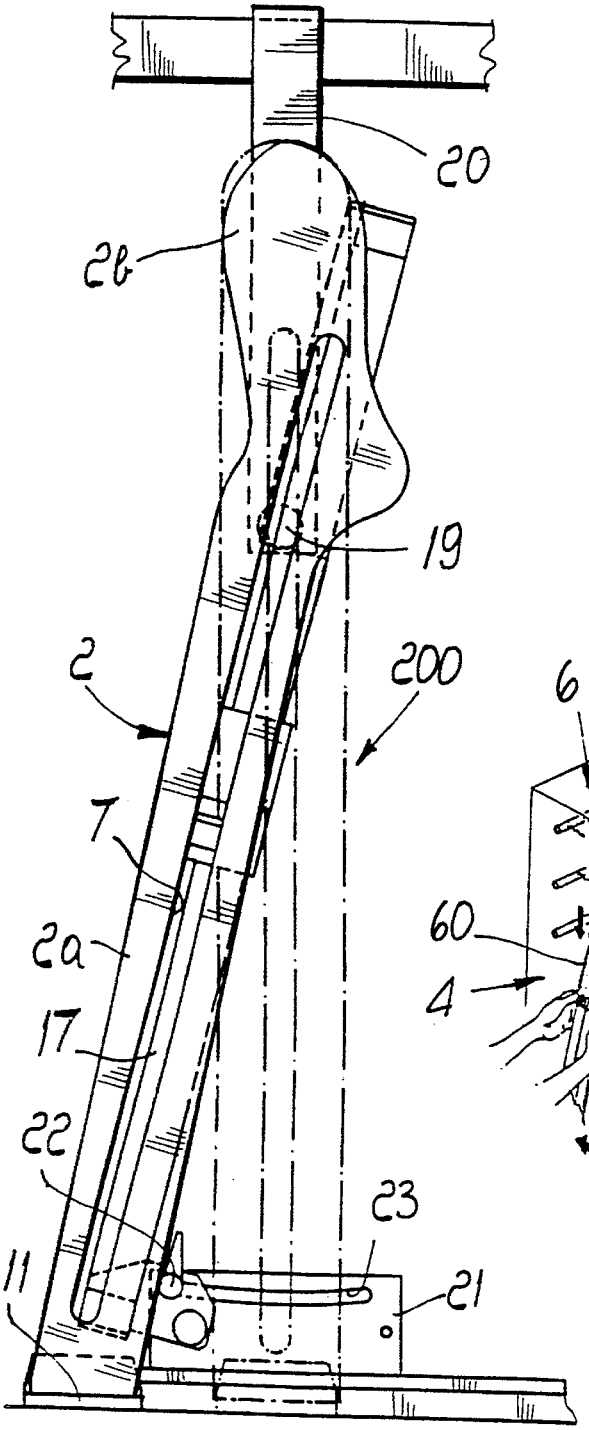
FIG. 4 is a side view of a shaped element arranged at the sock removal device.

As shown in FIG. 4, the shaped elements 2 are mounted at an angle on the corresponding couplings 11 so that the portion that forms the foot 2*b* is arranged so that it extends substantially vertically.

Downstream of the drying chamber 6 along the advancement direction A of the carousel 1 there is a removal station which is generally designated by the reference numeral 12. A lifting tooth 13 is arranged at the removal station 12 and is suitable to enter the slot 7 of the shaped elements 2 so as to act on the elasticized top of the sock. The lifting tooth 13 is rigidly coupled to the stem 14 of a jack 15 which is supported by a bracket 16 so that its axis is horizontally radial with respect to the carousel 1; said bracket 16 is movable along a post 17 that is rigidly coupled to the fixed frame of the machine, above the rotating platform 8. The bracket 16 is movable by being actuated by an actuation element 18 associated with the post 17.

The post 17 is supported so that it is inclined like the shape 2, in order to allow the lifting tooth 13 to slide along the slot 7 of said shape. Conveniently, the post 17 is mounted so as to be rotatable, by means of a pivot 19, on an upper upright 20 and so that it can be rigidly coupled to a plate 21 at its base in an adjustable position by means of a locking element 22; the plate 21 has a slot 23 having a curved profile and along which the locking element 22 is slideably guided. This allows to adjust the arrangement of the post 17 between an appropriately inclined position and a vertical position.

Figure 2:
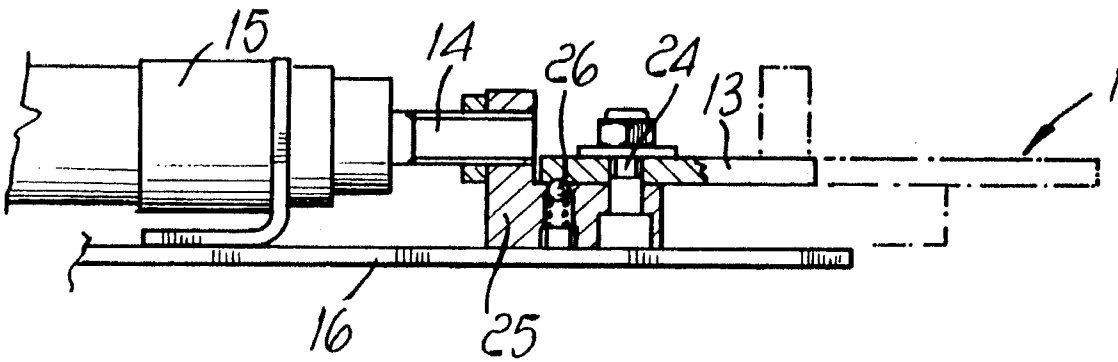
FIG. 2 is a detail view of the sock removal device.

More particularly, as shown in FIG. 2, the lifting tooth 13 is pivoted, about a pivot 24, to a slider 25 which is rigidly coupled to the stem 14 of the jack 15 and is elastically retained by a spring-loaded ball 26 which is accommodated in a seat formed in said slider 25. This allows to release the lifting tooth 13 from the radial working position in case of jamming or the like that may lead to the breakage of said tooth, for example if the stem 14 of the jack 15 jams in removal position; in this case the tooth 13 can in fact rotate tangentially to the carousel 1, overcoming the elastic contrast of the spring-loaded ball 26, so as to disengage from the shaped elements 2.

A device 27 for gripping the top of the shaped elements 2 is suitable to cooperate with the lifting tooth 13 and acts at the foot **2*b*. Said gripping device 27 has two pairs of arms 28 which can oscillate on a horizontal plane; each arm has a pad 29 made of sponge or the like. The arms 28 are supported, in a position that can be adjusted by means of plates 30 provided with appropriate slots, by two vertical rods 31 which are rotatable about their own axes. The rods 31 are guided, by means of appropriate bushes, so that they can slide through a plate 32 which is rigidly coupled to the fixed frame of the machine, and are rotatably supported by a frame 33 which is in turn slidingly guided along two posts 34 which are connected to the plate 32** in an upward region.

Figure 3:
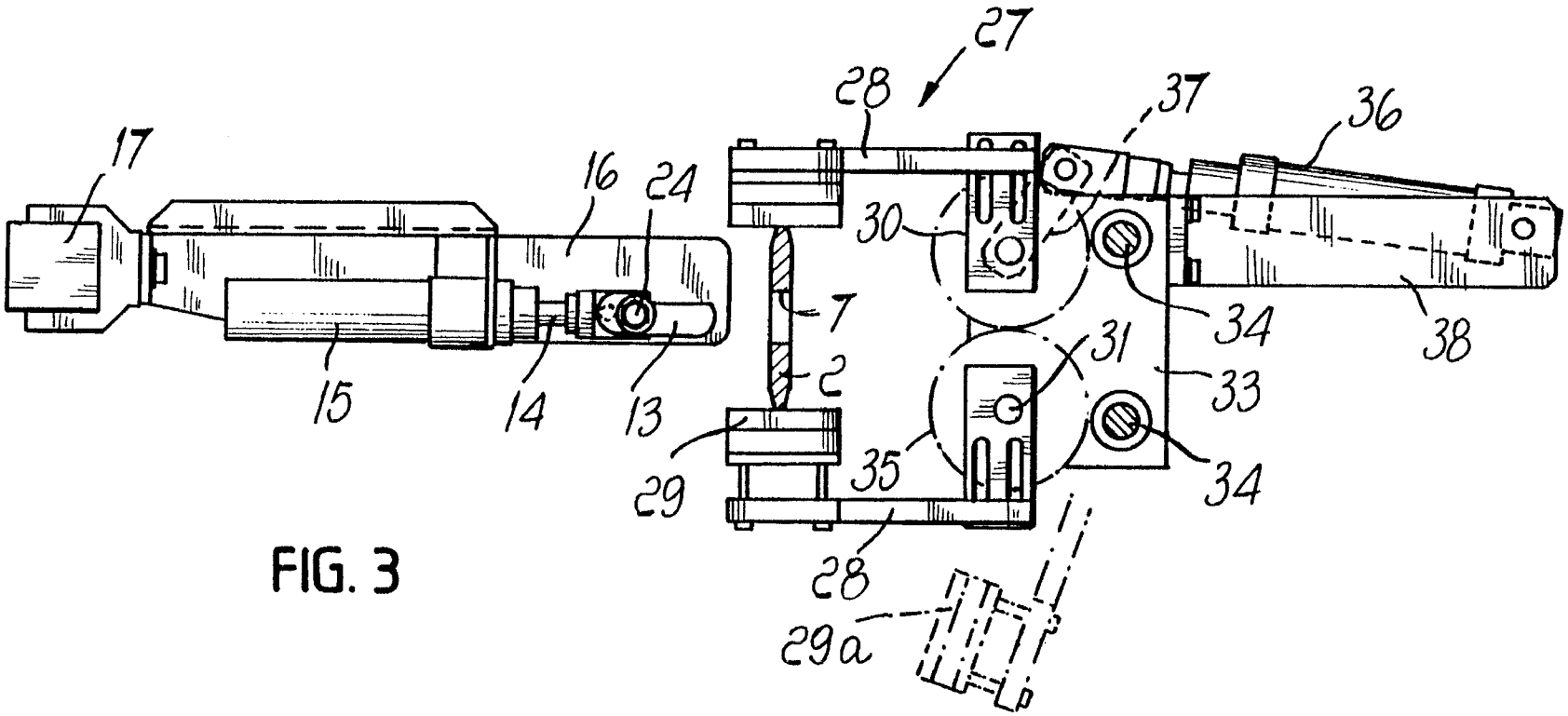
FIG. 3 is a transverse sectional view of the sock removal device.

Respective mutually meshing toothed wheels 35 are keyed to the rods 31 and are suitable to cause the reverse angular rotation of said rods and consequently of the arms 28 which support the pads 29. This rotation is actuated by a jack 36 which acts on one of the rods 31 by means of a lever 37 (FIG. 3). The jack 36 is horizontally supported by a bracket 38 which is rigidly coupled to the frame 33.

The posts 34 are connected in a downward region to a cross-member 39 which supports a jack 40 having a vertical axis. The stem of said jack 40 is rigidly coupled to the frame 33, so as to actuate the vertical movement of the gripping device 27.

The output unit 3 lies above the station 12 and has a removal belt 41 that winds around two rollers 42 and 43 which are rotatably supported on one side of a vertical plate 44. The plate 44 is pivoted on the axis 45 of the roller 43 so that it is possible to adjust its angular position by means of a traction element 46 which is rigidly coupled to the fixed frame of the machine.

A conterrotating abutment roller 47 is suitable to cooperate with the roller 42 during removal and is supported at the free end of an arm 48 which is pivoted to the plate 44 on an axis 49. The roller 47 draws its motion from the roller 42 by means of a transmission that includes a flexible element 50 which is driven by said roller 42, a gear 51 which is mounted at the axis 49, and an additional flexible element 52 which is driven by the gear 51.

A presser roller 53 is suitable to act on the active upper part of the belt 41 and is rotatably supported by the stem of a jack 54 which is supported by the plate 44 and acts at right angles to said belt 41; the roller 53 is actuated by means of a flexible transmission element 55 which draws its motion from the gear 51 at the axis 49.

The roller 53 is movable, under .the actuation of the jack 54, between an active position in which it is lowered onto the belt 41 and a position in which it is raised from said belt. The lowering of the roller 53 is actuated, when the sock arrives, by a photocell-based sensor element 56 arranged upstream of said roller; subsequent lifting is actuated by an additional sensor element 57 whose position is adjustable along a guide 58 which is arranged longitudinally with respect to the belt 41, downstream of said roller 53. An additional subsequent lowering of the roller 53 is actuated by appropriate timing means, as specified hereinafter.

The plate 44 furthermore supports, above the region where the rollers 42 and 47 act, a pipe 59 for delivering a flow of compressed air that is suitable to direct the sock onto the removal belt 41. The plate 44 must be adjusted so that the roller 47, by closing onto the roller 42, clamps the toe of the sock to be removed.

The operation of the described machine is as follows.

At the beginning of each working cycle, the operator who works at the station 4 fits and stretches the sock 60 on the shaped element 2 which is located at said station 4 and also checks that there are no defects (see the diagram of FIG. 5).

The carousel 1 then rotates so as to move the sock fitted on the shape inside the infrared-ray chamber 6. At the exit from the chamber 6, the sock is transferred at the station 12, where the described removal means operate. In this removal station 12 the portion **2*b* of the shaped element 2, which forms the foot, is clamped between the pads 29 of the gripping device 27, which close simultaneously starting from the spaced position shown by the dashed line 29a in FIG. 3**.

The jack 15 is actuated simultaneously and makes the lifting tooth 13 slide in the advanced position 13a, in which it can enter the longitudinal slot 7 of the shaped element 2 (FIG. 2). The unit that carries the lifting tooth 13 is initially in a position in which it is lowered onto the post 17; activation of the actuation element 18 drives the lifting stroke of the tooth 13 along the post 17. In this manner the tooth 13, by sliding along the slot 7 of the shape, acts on the elasticized top of the sock 60 and lifts it (see FIG. 5 again).

The simultaneous lifting of the pads 29, actuated by the jack 40 and shown by the dashed line **29*b* in FIG. 1, accompanies the removal of the sock 60 from the shape 2. The top of the sock is inserted between the conterrotating rollers 42 and 47; the closure of the abutment roller 47 onto the roller 42, performed by actuation means which are not shown, pulls said sock. The flow of compressed air that leaves the pipe 59 directs the sock 60 onto the belt 41**.

The rise of the pads 29 is appropriately delayed with respect to the ascent of the lifting tooth 13 by virtue of appropriate timing means with times that vary according to the length of the sock's body. Conveniently, the pads 29 act when the lifting tooth 13 has almost completed its stroke.

The fact should be particularly stressed that the lifting tooth 13 extends its active stroke along the slot 7 until it affects the shaped portion 2*b* of the shaped element 2, so as to make the sock pass beyond the discontinuity constituted by the heel of the foot formed by said shaped element.

When the sensor 56 detects the passage of the sock carried on the belt 41, the descent of the presser roller 53 into its lowered position is actuated, so as to act on said sock. The roller 53 rises automatically when the heel of the sock passes, so as to avoid forming an unwanted crease. likewise, when the heel passes the abutment roller 47 is moved away; at that time, however, the roller 53 is already engaged. The lifting of the presser roller 53 is controlled by the additional sensor 57, whose position is adjustable according to the size of the sock being processed. The subsequent descent of the roller 53 after the heel of the sock has passed is instead controlled by appropriate timing means.

The pressed sock 60 is then carried away on the output belt 61, which is aligned with the removal belt 41.

If so-called tube socks, i.e. socks that have a straight shape without a heel, are to be processed., the machine is equipped with correspondingly straight shaped elements which are mounted vertically on the carousel 1 as shown by the dashed line 200 in FIG. 4. In this case, the post 17 that guides the lifting finger 13 is also arranged vertically, by virtue of the possibility of adjusting its angular position with respect to the upper upright 20 by acting on the element 22 for locking to the plate 21.

To conclude, the described device allows to easily remove men's socks from the corresponding shaped elements in machines for checking, drying and pressing said socks. The removal device allows to avoid the formation of unwanted creases on the socks as well as damaging them.

In the practical embodiment of the invention, the materials employed, as well as the shapes and dimensions, may be any according to the requirements.

What is claimed is:

1. A removal device for machines for checking, drying and pressing socks, which comprises a carousel on the peripheral region whereof multiple shaped elements are distributed, respective socks being meant to be fitted on said shaped elements, said carousel being suitable to be moved stepwise at appropriate processing stations, wherein said device comprises, at a station for removing said socks from the corresponding shaped elements: a lifting tooth for entering a longitudinal slot of said shaped elements so as to act on the top of the sock and actuated by actuation means which act along an axis that lies horizontally and radially with respect to said carousel, said actuation means being slideably supported along a post that is rigidly coupled to a fixed frame of the machine and parallel to said shaped elements; means for gripping the top of said shaped elements and for lifting the end of the sock which have at least two arms that can oscillate on a horizontal plane, have a corresponding pad, and can be actuated so as to mutually open and close on supporting means which are meant for alternating vertical sliding; two rollers around which a removal belt winds, a conterrotating abutment roller supported at the end of an oscillating arm being suitable to cooperate with one of said rollers during removal; and a tube for delivering a flow of compressed air which lies above the region where said abutment roller acts and is suitable to direct the sock onto said removal belt.

2. Device according to claim 1, wherein a presser roller is suitable to act on an active part of said removal roller and is driven by means that provide a reciprocating motion in a direction that lies at right angles to said belt, so as to rise when the heel of the sock passes.

3. Device according to claim 2, wherein said presser roller is controlled by means for sensing the presence of said sock which are arranged upstream and downstream of said presser roller and are respectively suitable to lower said presser roller into its active position and to then lift it when the heel of the sock passes.

4. Device according to claim 1, wherein said shaped elements are mounted at an angle on related couplings, so that an upper portion that forms a foot is substantially vertical.

5. Device according to claim 4, wherein said lifting tooth extends its active stroke along said slot of the shaped elements until it affects said portion that forms a foot, so as to make the sock pass beyond the discontinuity constituted by the heel of the foot formed by said shaped elements.

6. Device according to claim 1, wherein said lifting tooth is rigidly coupled to the stem of a jack which is supported, with an axis that lies horizontally and radially with respect to said carousel, by a bracket that is movable along said post under the actuation of corresponding actuation means which are associated with said post.

7. Device according to claim 1, wherein said lifting tooth is pivoted, about a pivot having a vertical axis, to a slider that is rigidly coupled to said actuation means and is elastically retained by a spring-loaded ball which is accommodated in a seat formed in said slider, so as to allow to disengage said lifting tooth from the radial active position.

8. Device according to claim 1, wherein said post is mounted on an upper upright so as to be rotatable on a vertical plane and can be rigidly coupled at its base, in an adjustable position, to a plate provided with a slot having a curved profile and along which an element for locking said post is slidingly guided, so that said post can be adjusted between an appropriately inclined position and a vertical position.

* * * * *